US007182080B1

(12) United States Patent
O'Neal

(10) Patent No.: US 7,182,080 B1
(45) Date of Patent: Feb. 27, 2007

(54) APPARATUS AND METHOD FOR FINISHING STONE TILES

(76) Inventor: Steve O'Neal, 17029 E. Linvale Pl., Aurora, CO (US) 80013

( * ) Notice: Subject to any disclaimer, the term of this patent is extended or adjusted under 35 U.S.C. 154(b) by 0 days.

(21) Appl. No.: 11/062,197

(22) Filed: Feb. 18, 2005

Related U.S. Application Data

(60) Provisional application No. 60/546,557, filed on Feb. 20, 2004.

(51) Int. Cl.
*B28D 1/04* (2006.01)

(52) U.S. Cl. ..... 125/13.01; 451/44; 451/547; 83/698.11

(58) Field of Classification Search ..... 125/13.01, 125/13.03, 25, 35, 12; 83/471.2, 372, 437.1, 83/698.1, 477.2, 466.1; 269/16, 138; 451/44, 451/215, 177, 358, 547, 63
See application file for complete search history.

(56) References Cited

U.S. PATENT DOCUMENTS 5,676,124 A * 10/1997 Lee ..... 125/13.01
5,947,103 A * 9/1999 Saccon ..... 125/13.01
6,224,462 B1 * 5/2001 Yokoyama et al. ..... 451/10
6,264,186 B1 * 7/2001 Hill ..... 269/47
6,272,961 B1 * 8/2001 Lee ..... 83/581
6,752,139 B2 * 6/2004 Lee ..... 125/12

* cited by examiner

*Primary Examiner*—Jacob K. Ackun, Jr.
(74) *Attorney, Agent, or Firm*—Gregory J. Nelson

(57) ABSTRACT

The present invention relates to several embodiments of tools for finishing stone particularly stone tiles. The first embodiment is a production table on which a plurality of tiles can be secured within a cabinet so a worker may finish and polish the edges of the aligned tiles to produce a desired profile. Another embodiment of the invention relates to a modification of a standard tile saw in which any auxiliary carriage table is securable to the conveyer. The auxiliary table has an adjustable fence for precisely positioning a tile to be polished. The saw blade is replaced with an arbor to which a replaceable polishing ring can be secured. The rings are plastic having an abrasive surface defining various profiles and are provided in various grits. The tile is advanced by the table to bring the edge of the tile into engagement with the periphery of the ring to polish and profile the tile.

7 Claims, 5 Drawing Sheets

APPARATUS AND METHOD FOR FINISHING STONE TILES

CROSS REFERENCE IS MADE

This application is based on provisional patent application Ser. No. 60/546,557, filed Feb. 20, 2004, of the same title.

FIELD OF THE INVENTION

The present invention pertains to the field of finishing stone tiles and more particularly relates to an apparatus and method for finishing the edge of stone tiles with a suitable profile prior to installation. In one embodiment of the present invention, the invention pertains to a modification of heavy duty production tile saws to allow the tile saw to be used for edge profiling. In another embodiment, the present invention provides a production table which allows the contractor or installer to profile and polish the edges of a plurality of tiles in a single operation.

BACKGROUND OF THE INVENTION

As indicated above, the present invention pertains to apparatus and method for finishing stone tiles. The term "stone tile" as used herein includes tiles, various types of stone, including slate, travertine, marble, granite and similar tiles. Tiles of this type are commonly used to fabricate countertops, tabletops and are applied to various surfaces such as flooring surfaces. Tiles of these types may also be used for decorative facings, both in residential and commercial construction. Generally when stone of this type is processed, it is first cut at the quarry or at a fabricating location into tiles which are generally square but also may be rectangular. Standard tiles conventionally are 12×12 inches, 16×16 inches, 18×18 inches or, in some cases as large as 24×24 inches. The tiles are cut and generally the exposed surfaces polished. The edges of the tiles may be provided with a slight beveled or profiled edge.

At the time of installation, the contractor-installer will cut the tiles using a heavy duty production tile saw in accordance with the dimensions and geometry of the installation location. As an example, in the case of a countertop, it is generally necessary for the exposed outer edges of the tile to be profiled and finished. One common type of edge fabrication is the bull-nose edge on which the exposed edges are polished and rounded for an aesthetically pleasing appearance. Such finishing also eliminates sharp corners and edges which may present a safety hazard.

The contractor-installer may apply the bull-nose edge using a hand tool such as a heavy duty grinder, generally fitted with a suitable grinding or polishing wheel or pads. A conventional grinder has a motor with a shaft on which an arbor is located. The arbor receives grinding or polishing pads of different types such as diamond pads or pads containing a silicone carbide material. Polishing and profiling of the edge of such tiles is generally accomplished by clamping or securing the tiles in some manner and then manually bringing the abrasive face of the grinder pads into contact with the edge of the tile to be polished. In some cases it is necessary to use a plurality of pads of varying grits to achieve the desired finish. The polishing may be a dry polish or may be a wet polish.

The alternative to on-site finishing, as described above, is for the contractor-installer to determine the dimensions of the tiles that will require profiling and polishing. The contractor can then specify that the production plant provide tiles in accordance with the dimensional specifications. This is obviously a time-consuming and expensive operation. Further, if the contractor breaks or damages a tile that has been pre-finished, the contractor must either polish the replacement tile by hand or order a replacement from a supplier which further delays the project.

In view of this, there exists a need for apparatus and methods for convenient, on-site profiling and polishing of stone tiles of various types.

BRIEF SUMMARY OF THE INVENTION

The present invention fills a long-felt need and facilitates the fabrication in profiling and edge polishing of stone tiles onsite. In one embodiment, the present invention provides a table with an elongate, planar working surface on which a selected number of tiles may be secured in end-to-end relationship with the edges of the individual tiles to be profiled aligned. The term "profiling" refers to the application of a polished edge having a certain shape or configuration. A trough extends along the working surface and receives water that may be applied during a wet polishing operation. The water is directed to a sump or reservoir where it may be either recycled or held for disposal. A splash cover extends over the working surface to contain water and removed material within the confines of the apparatus so that it will not be discharged into the environment or the surrounding work area.

Preferably the supply lines for power and water are connected to a retractor so that they will be maintained in an out-of-the-way, non-interfering position and can be extended when required. Preferably the table is portable and may be transported to a job site and erected. Polishing the edges is accomplished by a manual, variable speed grinder or similar polishing tool having a polishing surface. The table is supported on foldable legs on casters. The casters allow the table to be moved about and then the casters may be locked so the table is secured in the use-position.

In another embodiment, the present invention provides a modification to conventional heavy duty production tile saws which allows a tile saw to be used at a job site for finishing and polishing the edge of a tile. The modification may be provided as an OEM item or an after-market item and includes a tray which is securable to the standard tile saw tray. An adjustable fence is provided on the tray so that the user may use the fence as a guide when profiling the edge of the tile positioned opposite the fence. Preferably the fence is adjustable at multiple locations along its length so that it may be precisely adjusted. When the production saw is to be used for polishing, the conventional saw blade is removed and replaced with a circular arbor plate which can be secured to the existing threaded shaft on the tile saw by a nut and lock washer. The diameter of the arbor plate may vary, but typically would be about 7¼ inches in diameter. The arbor plate may be metal or a hard plastic and has a surface with attachment means such as one component of a hook-and-loop fastener material. A removable polishing ring is detachably secured to the face of the arbor. The polishing ring has cooperating attachment means such as the mating component of a hook-and-loop fastener for rapid replacement and interchangeability. The polishing ring is provided with a peripheral polishing surface having a cross sectional configuration in accordance with the shape or profile to be applied to the edge of the tile. The polishing edge of the ring is impregnated with a suitable abrasive such as diamond dust or silicone carbide. Preferably the user would be provided with a plurality of polishing rings of various grits from which to select. Often the user will progressively polish the tile beginning with a coarser grit and proceeding to a finer grit.

BRIEF DESCRIPTION OF THE DRAWINGS

The above and other objects and advantages of the present invention will be more fully appreciated and understood from the following description, claims and drawings in which:

DETAILED DESCRIPTION OF THE DRAWINGS

Embodiments of FIGS. 1 to 8

Figure 1:
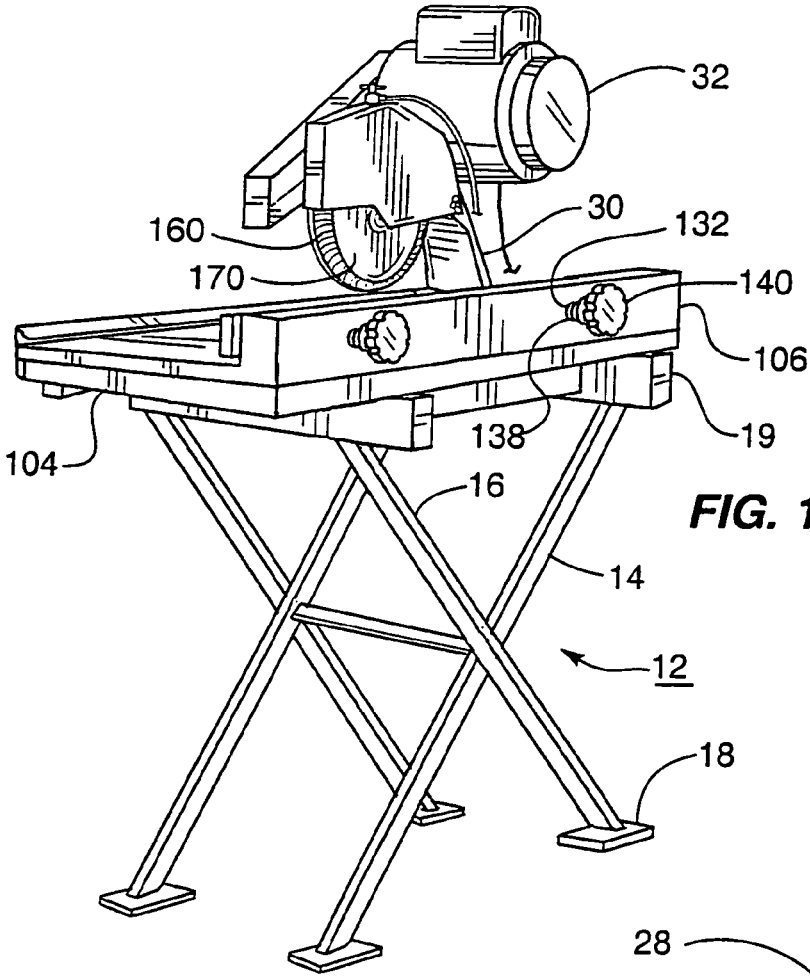
FIG. 1 is a perspective view of a first embodiment of the present invention shown in conjunction with a conventional production tile saw.

Turning now to the drawings, particularly FIGS. 1 through 8, a first embodiment of the present invention is shown which can be utilized with a conventional, heavy duty production tile saw such as the saw sold under the trademark Tilemaster®, it being understood that the invention is applicable to most conventional tile saws of the general type. The embodiment of the invention shown in these figures allows the user to quickly and easily adapt the conventional tile saw for use as an edge finishing and polishing tool. The conventional tile saw includes a stand 12 which is shown as having folding legs 14 and 16, each of which carries a foot 18 on its lower end. The stand 12, when erected, provides a stable base for the tile saw. The upper end of the legs carries support bars 19 on which the water pan rests. Tracks 20 extend from the front of the water pan to the rear of the water pan and support a conveyor cart 22. Wheels 23 help the cart 22 roll smoothly on the tracks. Conventionally, the cart is made of cast aluminum or polymeric material. The cart has a table 24 which defines a slot 21 at a central location which aligns with the standard cutting blade. The standard blade is not shown as it has been removed and is replaced with a polishing head in accordance with the present invention.

Tiles to be cut are placed on the table with the cart 22 positioned forwardly or toward the user. The user will align the cut with the slot 21 in the table and then manually move the conveyor cart 22 and tile rearwardly into engagement with the blade. The blade is powered by a high torque motor 32 through a drive system 27. The drive system drives the blade shaft 26 which carries a blade partially enclosed in the blade guard 28. A water pump is provided which will pump water from a source and direct water distribution to both sides of the blade through tube 30.

The above is a general description representative of various heavy duty production tile saws. With the present invention, the conventional tile saw, as described above, can be easily and quickly modified to operate as a finishing and polishing apparatus for imparting the desired shape to the edges of plurality of tiles, such as a bull nose configuration. The tile saw modification, according to the present invention, includes a table 100 which has a horizontal base 102, generally conforming to the size and shape of the conveyor cart. The base 102 has front side 104, rear side 106 and opposite sides 108 and 110. A flange 135 projects upwardly along side 108 extending from front 104 of the table to the rear 106 of the table 100.

Figure 3:
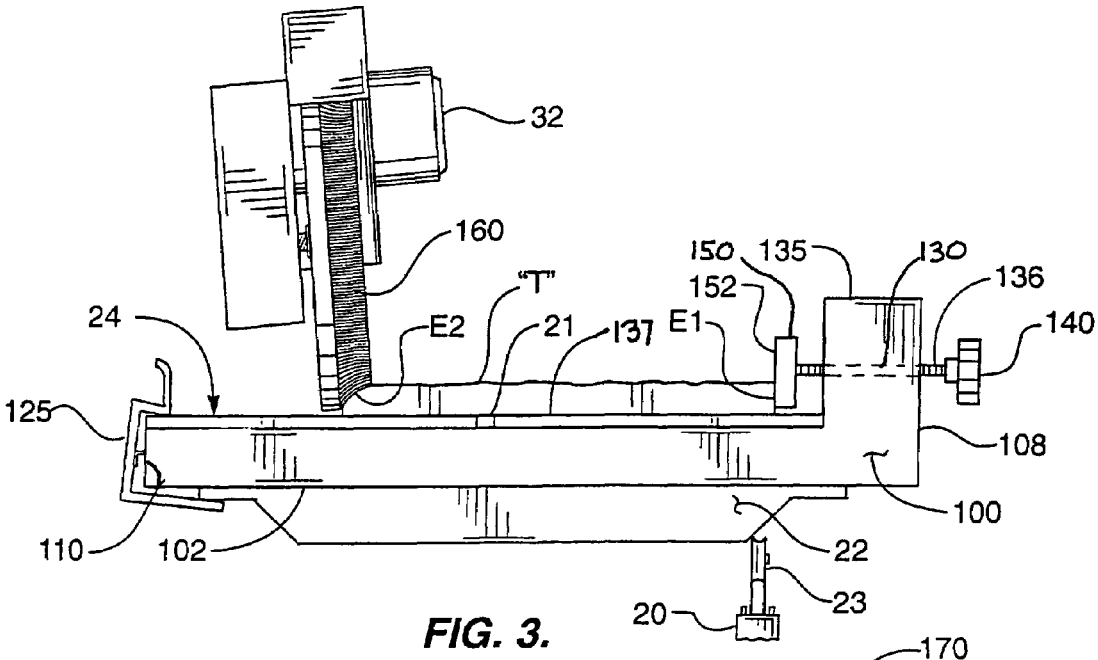
FIG. 3 is a front view of a production saw modified in accordance with the present invention.
Figure 4:
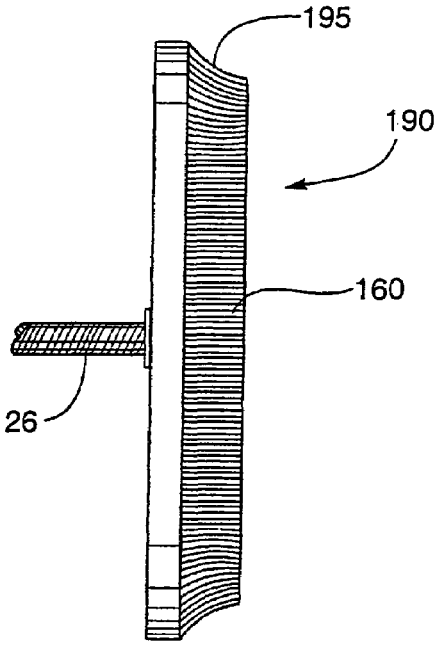
FIG. 4 is a side view of the polishing head comprising an arbor and attached polishing ring.

The table is removable and, when used, may be secured to the conveyor by a clamp 125 as seen in FIG. 3. Clamps may be provided at several locations to secure the polishing table to the conveyor cart 22. Threaded bores 130 and 132 are provided at spaced-apart locations extending through the flange 135 parallel to the working surface 135 of the table. The threaded bores 130 and 132 each receive a threaded shafts 136, 138 each having a knob 140 on their outer ends. The inner end of the threaded shafts are secured to one side of a fence 150. The opposite side of the fence 140 provides a guide surface 152 against which an edge of the tile "T" abuts during the finishing operation. This is best seen in FIG. 3. By providing at least two adjustment points along the axial length of the fence 150, precise adjustment of the fence can be achieved to insure accuracy of the tile profiling and finishing operation.

Figure 5:
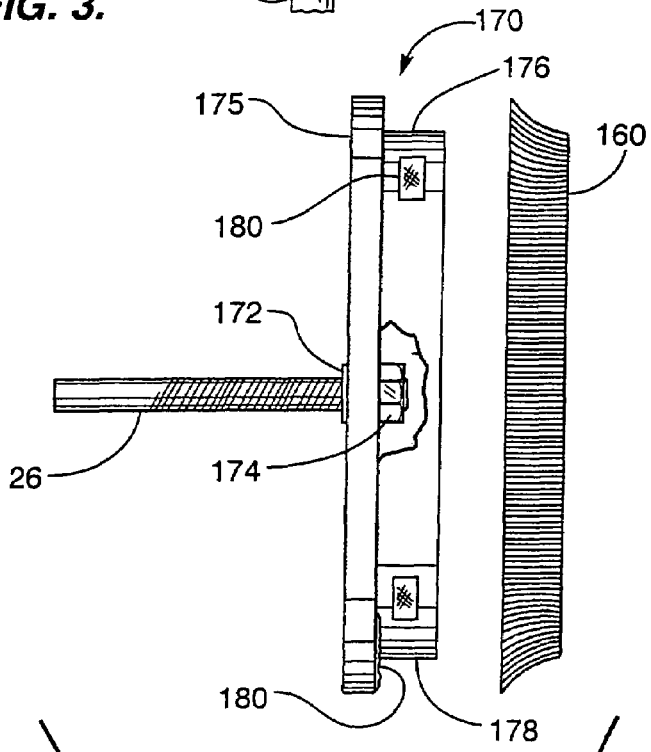
FIG. 5 is a view similar to FIG. 4 with the polishing ring removed from the polishing head.
Figure 6:
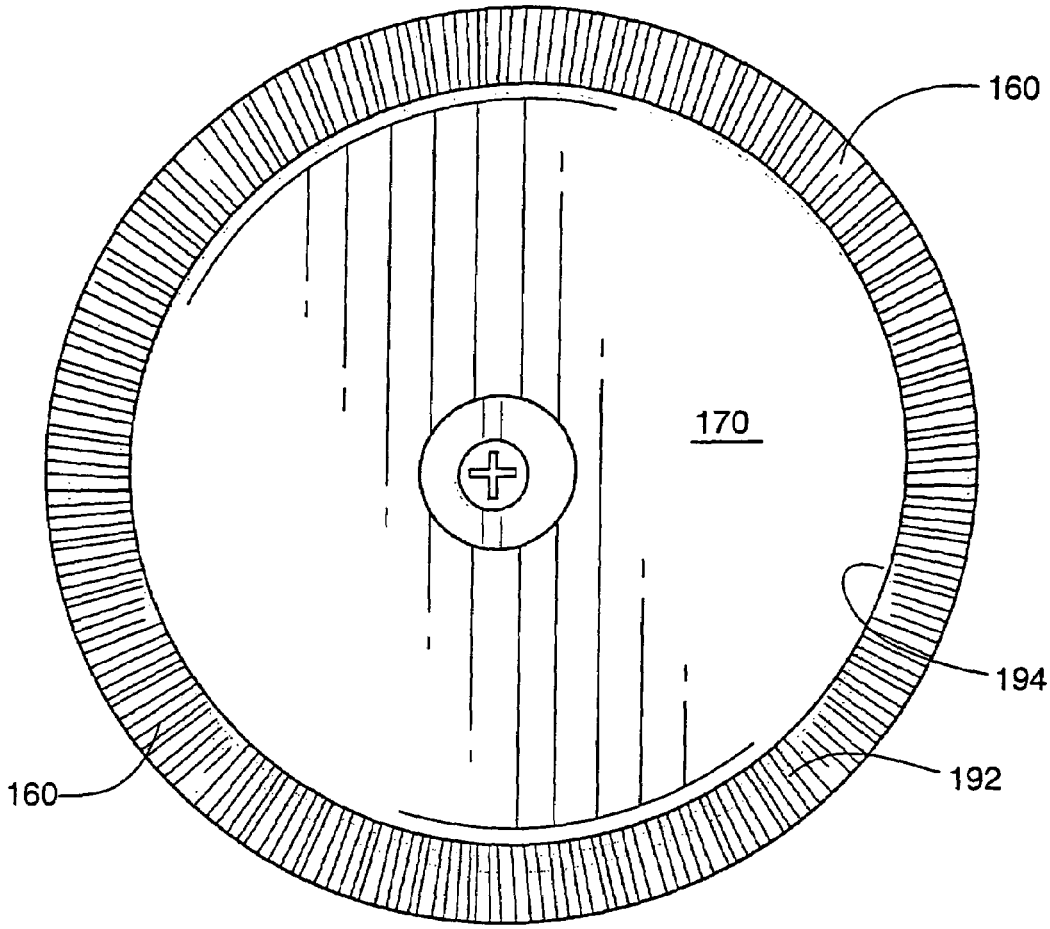
FIG. 6 is a front view of the polishing arbor with a polishing ring attached.

Polishing is achieved by a polishing head having an arbor 170 and interchangeable polishing rings 160. The arbor is secured to the blade drive shaft 26 once the blade has been removed. The blade is replaced with an arbor 170 which has a bore that receives shaft 26 and is secured by a washer 172 and nut 174, as seen in FIG. 5. The arbor is shown having a generally circular backing plate 175 of a first greater diameter and a concentric support plate 176 of a lesser diameter. The arbor may be made from any suitable material such as a suitable high-impact polymeric material or a metal such as aluminum or steel. The periphery 178 of the support plate 176 and the surface of plate 175 are provided with fastening means 180 to secure the polishing ring 160 in place. The fastening means 180 are preferably one component of a loop-and-hook type fastener material applied either continuously or intermittently around the periphery of the support on plate.

Polishing ring 160 consists of an annular body 192 having a inner circular surface 194 and an outer finishing surface 195. The inner circular surface 194 of the polishing ring 160 has a diameter closely conforming to the diameter of the support plate 176. A mating fastener component 196, such as the mating component of a loop-and-hook-type fastener, is provided on the inner surface of the polishing ring. Thus, the polishing ring can be easily attached and removed from the arbor. The support plate 176 both centrally positions the annular ring 160 on the arbor and maintains the shape of the ring during the finishing operation.

Figure 7:
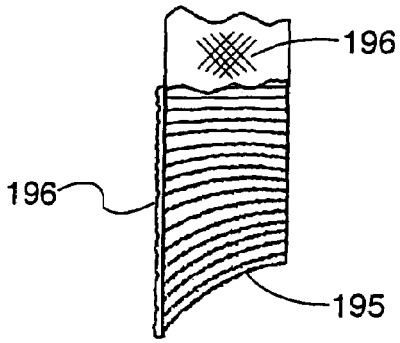
FIG. 7 is a detail view of the polishing ring showing a representative configuration.
Figure 8:
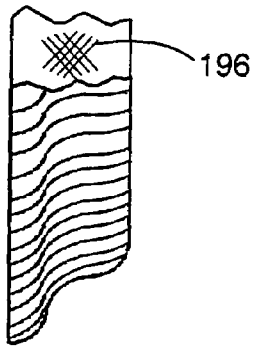
FIG. 8 is a view similar to FIG. 7 showing yet another configuration for the polishing ring.

The peripheral outer surface 195 of the polishing ring may have any desired configuration such as a curve or a radius as shown in FIG. 7, or an ogee configuration shown as a FIG.

8 or any other configuration such as a bevel or chamfer configuration. The polishing ring is preferably a durable molded plastic such as styrene, urethane, polyvinylchloride with a peripheral finishing surface 195 which has a suitable abrasive such as diamond dust or silicone carbide embedded into the surface. Polishing rings would be made available to the user in a plurality of grits typically ranging between 400 to 1800 grit so that the installer may select a courser grit for initial material removed and progressively proceed with the finishing and polishing operation using finer grits.

Figure 2:
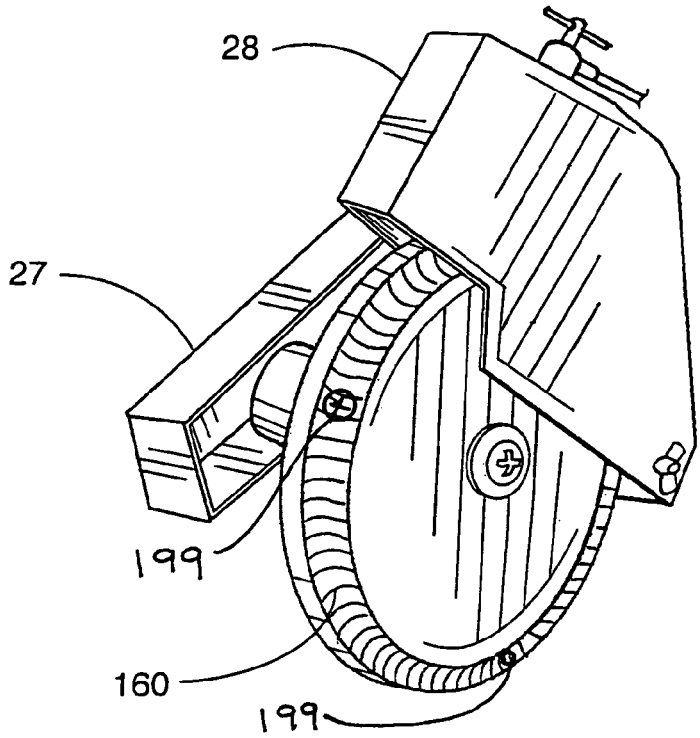
FIG. 2 is a detail view of the blade shaft and blade guard of the tile saw shown in FIG. 1 modified to incorporate a polishing head according to the present invention.

In use, a tile T, as shown in FIG. 3, would be placed on the horizontal surface 137 of the table 100. The edge E1 of the tile would be abutted against the fence 150 and the fence adjusted at knobs 140 so that the edge to be finished, edge E2, is precisely square and is aligned with the abrasive surface 195 of the polishing ring 160. The conveyor 22 and table 100 are in a forward position and the motor is energized causing the arbor and polishing ring to rotate at a high speed, generally between 1400 to 1600 rpm. The conveyor is then manually moved rearwardly causing material to be removed from edge E2 of the tile. As additional passes are made, the fence 150 can be adjusted to move the tile leftwardly. Further, as finishing progresses, the polishing ring 160 can be removed and replaced with one or more polishing rings having finer grit abrasive. The use of loop-and-hook fasteners to attach the rings, such as Velcro®, is preferred, although the rings can be removably attached to the arbor using other types of fasteners such as recessed cap screws 199 extending into threaded bores in the arbor plate as seen in FIG. 2.

Embodiment of FIGS. 9 to 12

Turning now to FIGS. 9 through 12, another embodiment of the present invention is shown. As mentioned above, this embodiment relates to a production apparatus having a table 200 designed to hold a plurality of stone tiles, T1, T2, etc., in place while their edges are being subjected to polishing and finishing in the desired profile. The polishing table is generally designated by the numeral 200 and includes an elongate, planar working surface 202. The table has a cabinet with a front 204, rear 206 and opposite sides 208 and 210. The table can be of any desired length and for convenience of use and transporting generally will be about 10 feet long which will accommodate approximately 10 12" square tiles or five 24" square tiles. The sides 208 and 210 are "L" shaped so that a working access opening 212 extends along the front. The table is supported on folding legs 220 and 222. The legs can be locked in a selected extended position at brackets 225. The ends of the legs each carry a caster 230 so that the table can be easily moved about once in place. In the working position, the casters are locking casters so that, once in position, the table can be secured against movement. Locking is achieved by locking levers 232.

An inwardly curved splash guard 240 extends substantially the full length along the front edge 204 of the table, partially extending into the access area. The opposite ends 208, 210 of the table each have an upstanding section which supports a cover 242 which also extends substantially the entire length of the table and has a front edge 244 which curves downwardly. A working compartment 250 is defined under the cover.

Polishing is preferably accomplished by using a hand-held polishing tool 255 such as a variable speed polisher or grinder of the type sold by Hitachi® using suitable grinding wheels and polishing pads. In some instances, polishing and finishing may be a dry operation and others a wet operation. For wet operations, water lines 270 extend from pump "P" through a retractor 275 located at a central location on the hood or cover 242. The retractor will also feed power cable 274 to the grinder 255. By running the power and water lines through the retractor, convenience is provided and entanglement and interference of these lines during the polishing operation is reduced. Industrial cord retractors of this type are well known and commonly used at automotive and other shops and are available from such manufacturers as Northern Industrial Electric.

A water trough 280 extends the length of the table at the front of the table and terminates above a reservoir 282 which will collect the water that runs from the polishing table. The reservoir may be periodically flushed by removing the drain plug 284.

Tiles T1, T2, T3, etc., are positioned in aligned arrangement on the work surface with the edges to be polished disposed toward the front of the table. The access opening provides the worker access to the table and to the tiles. The splash guard and cover will help to maintain water and any residue from the polishing operation within the confines of the machine to be flushed by the water into the reservoir.

To maintain the tiles in position during the polishing operation, a clamping device 290 is provided. The clamping device includes an elongate lead screw 92 extending axially in a recess 293 in the table. The lead screw terminates at a fixed anvil 295 at one end. A moveable clamp 294 is in opposed relationship with a fixed clamp and is threaded to receive the lead screw. The fixed clamp extends through a guide slot in the table. Actuation means, shown as a crank 296, is provided at the end of the table attached to the lead screw. The number of tiles desired to be finished are placed on the table with the edges disposed towards the front of the table, preferably extending passed the front edge of the table. The clamp 290 is then tightened either manually or by a motor, not shown, to move the clamp into position to secure the tiles between the fixed clamp and the moveable clamp.

The workman will then proceed with finishing the edges of the tiles with the desired configuration using a hand grinder 255 as explained above. Water is supplied through retractable line 270 extending from the retractor and power is supplied by the retractable power line 272. Water distributed during the polishing process will run off the table or through the holes 291 in the table into the trough 280 and will flow into the reservoir. Water will also carry away tile residue and grit. Preferably the water supply is a clean supply separate from the pump reservoir. The water may also be recycled from the reservoir 282.

Figure 9:
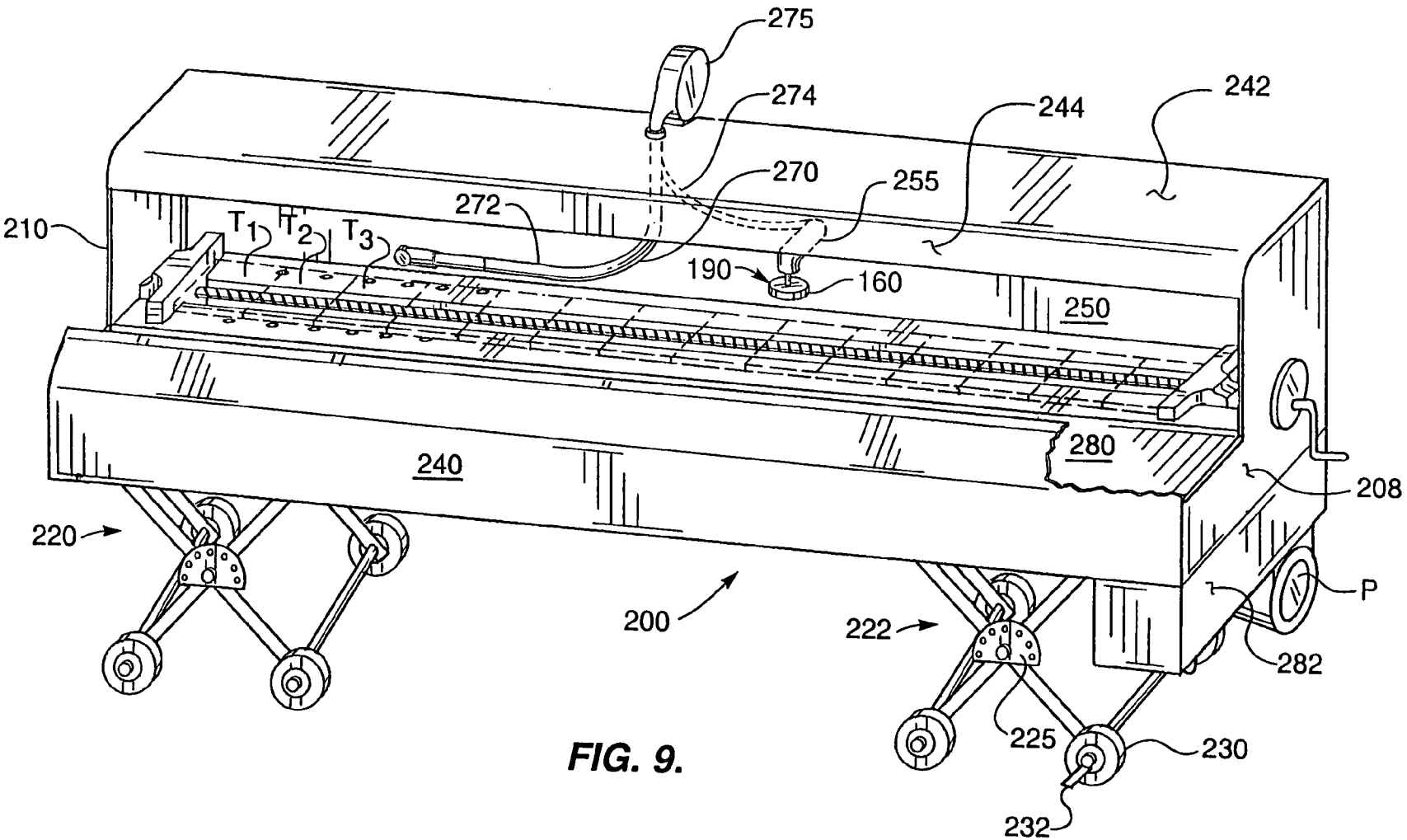
FIG. 9 is a perspective view of another embodiment of the present invention for holding stone tiles in place to facilitate the manual polishing of the edges prior to installation.
Figure 10:
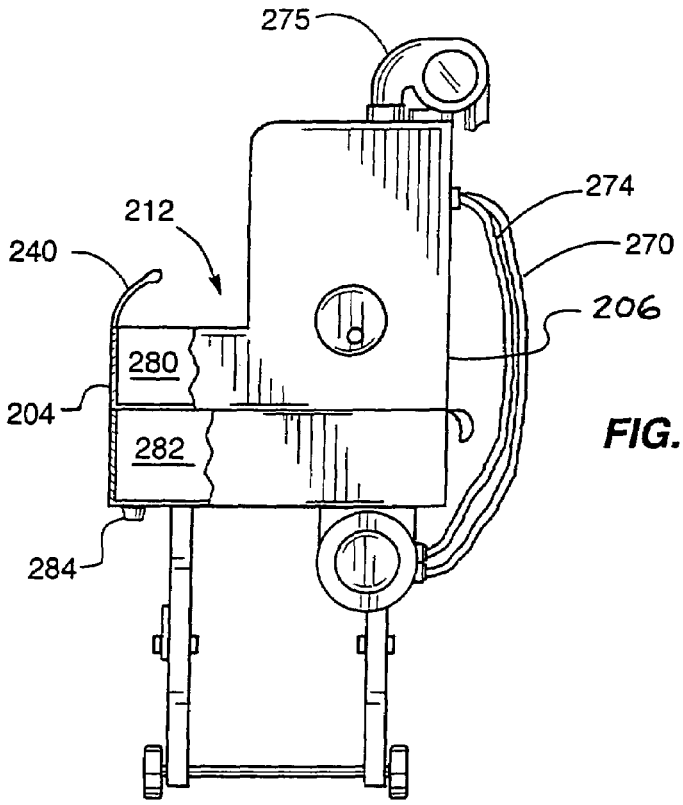
FIG. 10 is an end view of the polishing table of FIG. 9.
Figure 11:
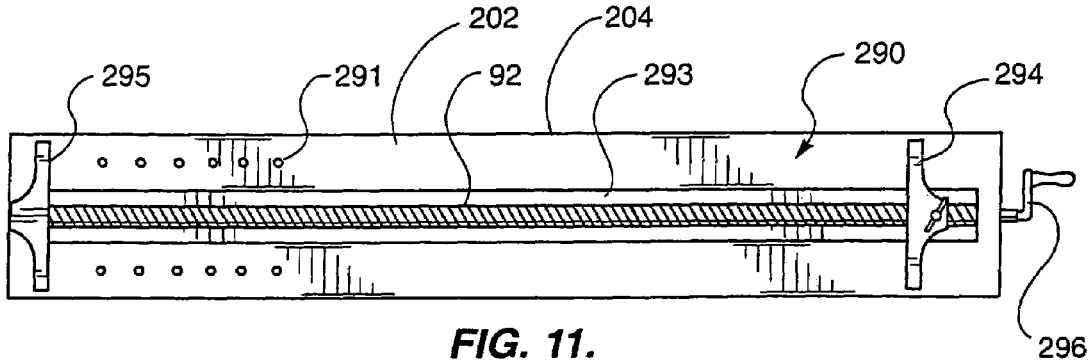
FIG. 11 is a top view of the table and clamping arrangement for securing tiles to be processed in place.
Figure 12:
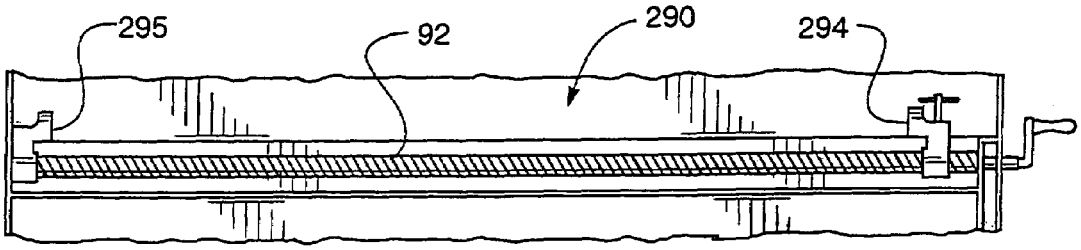
FIG. 12 is a side view of a portion of the polishing table indicating the clamping arrangement for securing tiles in place for edge finishing and polishing.

The clamping mechanism can also be a slide arrangement instead of the lead screw as shown in FIG. 9. In the slide arrangement, the clamp is slidable along an axial rod to the desired position engaging tiles to be held in place. The slide can then be locked in place by release of the clamping mechanism. Slide and bar clamps of this type are well known in the wood working field and are available from companies such as Rocklen.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A polishing apparatus for attachment to a production tile saw of the type having a moveable saw tray and a motor driven blade shaft, said apparatus comprising:

(a) an auxiliary tray having a planar surface and a front, a rear and a side edge, said auxiliary tray being detachably securable to said moveable saw tray;

(b) a guide fence extending along a side edge of said auxiliary tray;

(c) adjustment means for adjusting the position of said fence on said planar surface;

(d) arbor means having a peripheral mounting surface, said arbor means being securable to said blade shaft for rotation therewith; and (e) at least one annular polishing ring having a peripheral polishing edge with a profile of predetermined shape, said ring being detachably securable to said arbor means at said peripheral mounting surface.

2. The polishing apparatus of claim 1 wherein said arbor has a backing plate and a support plate and said ring is detachably securable to at least one of said backing plate and support plate by loop and hook fastening material.

3. The polishing apparatus of claim 1 wherein said arbor is plastic having an abrasive material on said profile.

4. The polishing apparatus of claim 1 wherein said arbor is metal having an abrasive material on said profile.

5. The polishing apparatus of claim 1 wherein said fence is angularly adjustable with respect to said arbor means at two locations along its length.

6. The polishing apparatus of claim 5 wherein said fence is angularly adjustable by means of threaded rods extending through threaded bore in said edge.

7. A polishing attachment for a tile saw of the type having a motor driven blade shaft, said attachment comprising:

(a) an arbor having a backing plate and a support plate defining an annular mounting surface, said arbor being securable to the said blade shaft for rotation therewith;

(b) an annular polishing ring having an inner surface and a back surface positionable on said mounting surface, said ring having an inter peripheral surface defining a profile of predetermined shape for polishing an edge of a tile; and (c) means for detachably securing said ring to said mounting surface whereby said ring may be removed and interchanged with another ring.

* * * * *